US011232778B1

(12) United States Patent
Farahbakhsh

(10) Patent No.: US 11,232,778 B1
(45) Date of Patent: Jan. 25, 2022

(54) SYSTEMS AND METHODS FOR DETECTING DIVERGENCE IN AN ADAPTIVE SYSTEM

(71) Applicant: Bose Corporation, Framingham, MA (US)

(72) Inventor: Siamak Farahbakhsh, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/935,979

(22) Filed: Jul. 22, 2020

(51) Int. Cl.
*G10K 11/178* (2006.01)

(52) U.S. Cl.
CPC .. *G10K 11/17854* (2018.01); *G10K 11/17875* (2018.01); *G10K 2210/12821* (2013.01); *G10K 2210/3023* (2013.01); *G10K 2210/3026* (2013.01); *G10K 2210/3028* (2013.01)

(58) Field of Classification Search
None
See application file for complete search history.

(56) References Cited

U.S. PATENT DOCUMENTS 10,672,378 B1 6/2020 Bastyr et al.
10,586,524 B1 10/2020 Jain et al.
2017/0004816 A1* 1/2017 Yano ..... G01H 1/00
2017/0365245 A1 12/2017 Ku
2020/0135162 A1 4/2020 Hein et al.
2020/0357377 A1* 11/2020 Bastyr ..... G10K 11/17833

OTHER PUBLICATIONS

International Search Report and Written Opinion for PCT/US2021/070914, dated Oct. 20, 2021, pp. 1-13.

* cited by examiner

*Primary Examiner* — Kenny H Truong
(74) *Attorney, Agent, or Firm* — Bond, Schoeneck & King, PLLC

(57) ABSTRACT

Detecting a divergence in an adaptive system includes the steps of determining a power of a component of an error signal at a first frequency, the component being correlated to a noise-cancellation signal, the noise-cancellation signal being produced by an adaptive filter and being configured to cancel noise within a predetermined volume when transduced into acoustic signal, wherein the error signal represents a magnitude of a residual noise within the predetermined volume; determining a time gradient of the power of the component of the error signal; and comparing a metric to a threshold, wherein the metric is based, at least in part, on a value of the time gradient of the power of the component of the error signal over a period of time.

20 Claims, 9 Drawing Sheets

SYSTEMS AND METHODS FOR DETECTING DIVERGENCE IN AN ADAPTIVE SYSTEM

BACKGROUND

The present disclosure generally relates to systems and methods for detecting divergence in an adaptive system.

SUMMARY

All examples and features mentioned below can be combined in any technically possible way.

According to an aspect, a non-transitory storage medium storing program code for detecting divergence or instability in a noise-cancellation system, the program code, being executed by a processor, includes the steps of: determining a power of a component of an error signal at a first frequency, the component being correlated to a noise-cancellation signal, the noise-cancellation signal being produced by an adaptive filter and being configured to cancel noise within a predetermined volume when transduced into acoustic signal, wherein the error signal represents a magnitude of a residual noise within the predetermined volume; determining a time gradient of the power of the component of the error signal; and comparing a metric to a threshold, wherein the metric is based, at least in part, on a value of the time gradient of the power of the component of the error signal over a period of time.

In an example, the program code further comprises the step of: transitioning a first set of coefficients of the adaptive filter to a second set of coefficients of the adaptive filter upon determining that the metric exceeds the threshold.

In an example, the program code further comprises the step of slowing a rate of adaptation of the adaptive filter if the power of the correlated component begins decreasing as a result of transitioning the first set of coefficients to the second set of coefficients.

In an example, the program code further comprises the step of: transitioning to a third set of coefficients of the adaptive filter upon determining that the metric exceeds the threshold within a second period of time of storing a second set of coefficients.

In an example, the metric is a filtered representation of the time gradient over the period of time, wherein the representation of the time gradient is filtered with a low-pass filter.

In an example, a cut-off frequency of the low-pass filter is selected according the first frequency.

In an example, the program code further comprises the steps of: comparing a second metric to a second threshold, wherein the second metric is based on a comparison of the power of the component of the error signal at the first frequency to the power of the component of the error signal at at least a second frequency.

In an example, the program code further comprises the step of: transitioning a first set of coefficients of the adaptive filter to a second set of coefficients of the adaptive filter, upon determining that either the metric exceeds the threshold or the second metric exceeds the second threshold.

In an example, the program code further comprises the step of slowing a rate of adaptation of the adaptive filter if the power of the correlated component begins decreasing as a result of transitioning the first set of coefficients to the second set of coefficients.

In an example, the second metric is a filtered representation of a relative power of the component of the error signal at the first frequency and the component of the error signal at the second frequency, wherein the representation of the relative power is filtered with a low-pass filter.

According to another aspect, a method for detecting divergence in a noise-cancellation system, includes: determining a power of a component of an error signal at a first frequency, the component being correlated to a noise-cancellation signal, the noise-cancellation signal being produced by an adaptive filter and being configured to cancel noise within a predetermined volume when transduced into acoustic signal, wherein the error signal represents a magnitude of a residual noise within the predetermined volume; determining a time gradient of the power of the component of the error signal; and comparing a metric to a threshold, wherein the metric is based, at least in part, on a value of the time gradient of the power of the component of the error signal over a period of time.

In an example, the method further includes the step of: transitioning a first set of coefficients of the adaptive filter to a second set of coefficients of the adaptive filter upon determining that the metric exceeds the threshold.

In an example, the method further includes the step of: slowing a rate of adaptation of the adaptive filter if the power of the correlated component begins decreasing as a result of transitioning the first set of coefficients to the second set of coefficients.

In an example, the method further includes the step of: transitioning to a third set of coefficients of the adaptive filter upon determining that the metric exceeds the threshold within a second period of time of storing a second set of coefficients.

In an example, the metric is a filtered representation of the time gradient over the period of time, wherein the representation of the time gradient is filtered with a low-pass filter.

In an example, a cut-off frequency of the low-pass filter is selected according the first frequency.

In an example, the method further includes the step of: comparing a second metric to a second threshold, wherein the second metric is based on a comparison of the power of the component of the error signal at the first frequency to the power of the component of the error signal at at least a second frequency.

In an example, the method further includes the step of: transitioning a first set of coefficients of the adaptive filter to a second set of coefficients of the adaptive filter upon determining that either the metric exceeds the threshold or the second metric exceeds the second threshold.

In an example, the method further includes the step of: slowing a rate of adaptation of the adaptive filter if the power of the correlated component begins decreasing as a result of transitioning the first set of coefficients to the second set of coefficients.

In an example, the second metric is a filtered representation of a relative power of the component of the error signal at the first frequency and the component of the error signal at the second frequency, wherein the representation of the relative power is filtered with a low-pass filter.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Adaptive systems, such as noise-cancellation systems, typically employ feedback or feedforward topologies to adjust the adaptive system parameters according to the requirements of the environment. Generally, these systems will converge to a state that minimizes a particular value. For example, a noise-cancellation system may adapt parameters according to feedback from an error sensor in order to minimize noise within a particular area. In this case, the noise-cancellation system will converge toward zero noise within the area.

However, if an adaptive system fails, the system may diverge from the particular value. In a worst case scenario, this will exacerbate, rather than minimize the intended value. Thus, in the noise-cancellation example, a noise-cancellation system that diverges can add noise to the area, rather than cancel noise.

Various examples disclosed herein are directed to a system for detecting divergence in an adaptive system, such as a noise cancellation system. In some examples, once a divergence is detected, a corrective action may be taken to mitigate the effect of the divergence on the adaptive system.

Figure 1:
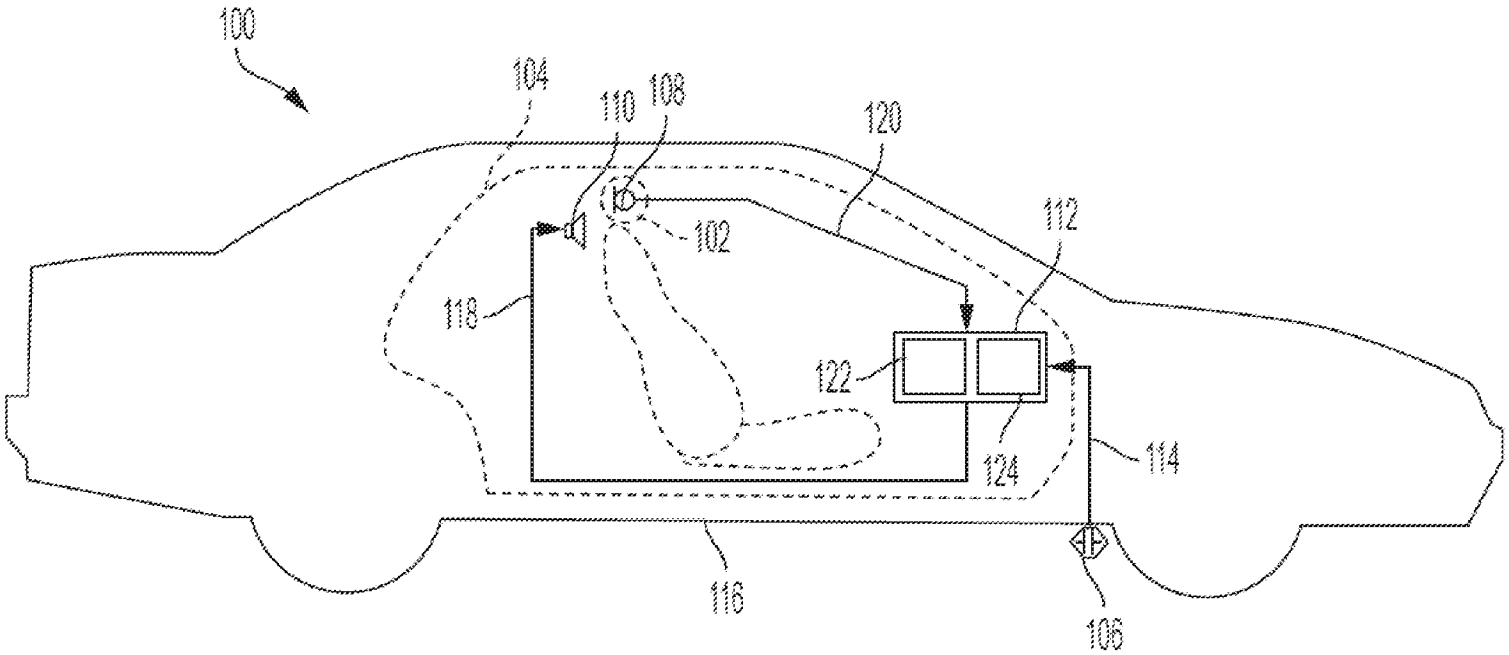
FIG. 1 depicts a schematic of a road-noise cancellation system, according to an example.

FIG. 1 is a schematic view of an example noise-cancellation system 100. Noise-cancellation system 100 can be configured to destructively interfere with undesired sound in at least one cancellation zone 102 within a predefined volume 104 such as a vehicle cabin. At a high level, an example of noise-cancellation system 100 can include a reference sensor 106, an error sensor 108, an actuator 110, and a controller 112.

In an example, reference sensor 106 is configured to generate noise signal(s) 114 representative of the undesired sound, or a source of the undesired sound, within predefined volume 104. For example, as shown in FIG. 1, reference sensor 106 can be an accelerometer, or a plurality of accelerometers, mounted to and configured to detect vibrations transmitted through a vehicle structure 116. Vibrations transmitted through the vehicle structure 116 are transduced by the structure into undesired sound in the vehicle cabin (perceived as road noise), thus an accelerometer mounted to the structure provides a signal representative of the undesired sound Actuator 110 can, for example, be speakers distributed in discrete locations about the perimeter of the predefined volume. In an example, four or more speakers can be disposed within a vehicle cabin, each of the four speakers being located within a respective door of the vehicle and configured to project sound into the vehicle cabin. In alternate examples, speakers can be located within a headrest, or elsewhere in the vehicle cabin.

A noise-cancellation signal 118 can be generated by controller 112 and provided to one or more speakers in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise-cancellation within one or more predefined cancellation zones 102 with the predefined volume. The noise-cancellation within the cancellation zones can effect a reduction in undesired sound by approximately 3 dB or more (although in varying examples, different amounts of noise-cancellation can occur). Furthermore, the noise-cancellation can cancel sounds in a range of frequencies, such as frequencies less than approximately 350 Hz (although other ranges are possible).

Error sensor 108, disposed within the predefined volume, generates an error sensor signal 120 based on detection of residual noise resulting from the combination of the sound waves generated from the noise-cancellation signal 118 and the undesired sound in the cancellation zone. The error sensor signal 120 is provided to controller 112 as feedback, error sensor signal 120 representing residual noise uncanceled by the noise-cancellation signal. Error sensors 108 can be, for example, at least one microphone mounted within a vehicle cabin (e.g., in the roof, headrests, pillars, or elsewhere within the cabin).

It should be noted that the cancellation zone(s) can be positioned remotely from error sensor 108. In this case, the error sensor signal 120 can be filtered to represent an estimate of the residual noise in the cancellation zone(s). In either case, the error signal will be understood to represent residual undesired noise in the cancellation zone.

In an example, controller 112 can comprise a nontransitory storage medium 122 and processor 124. In an example, non-transitory storage medium 122 can store program code that, when executed by processor 124, implements the various filters and algorithms described below. Controller 112 can be implemented in hardware and/or software. For example, controller can be implemented by a SHARC floating-point DSP processor, but it should be understood that controller can be implemented by any other processor, FPGA, ASIC, or other suitable hardware.

Figure 2:
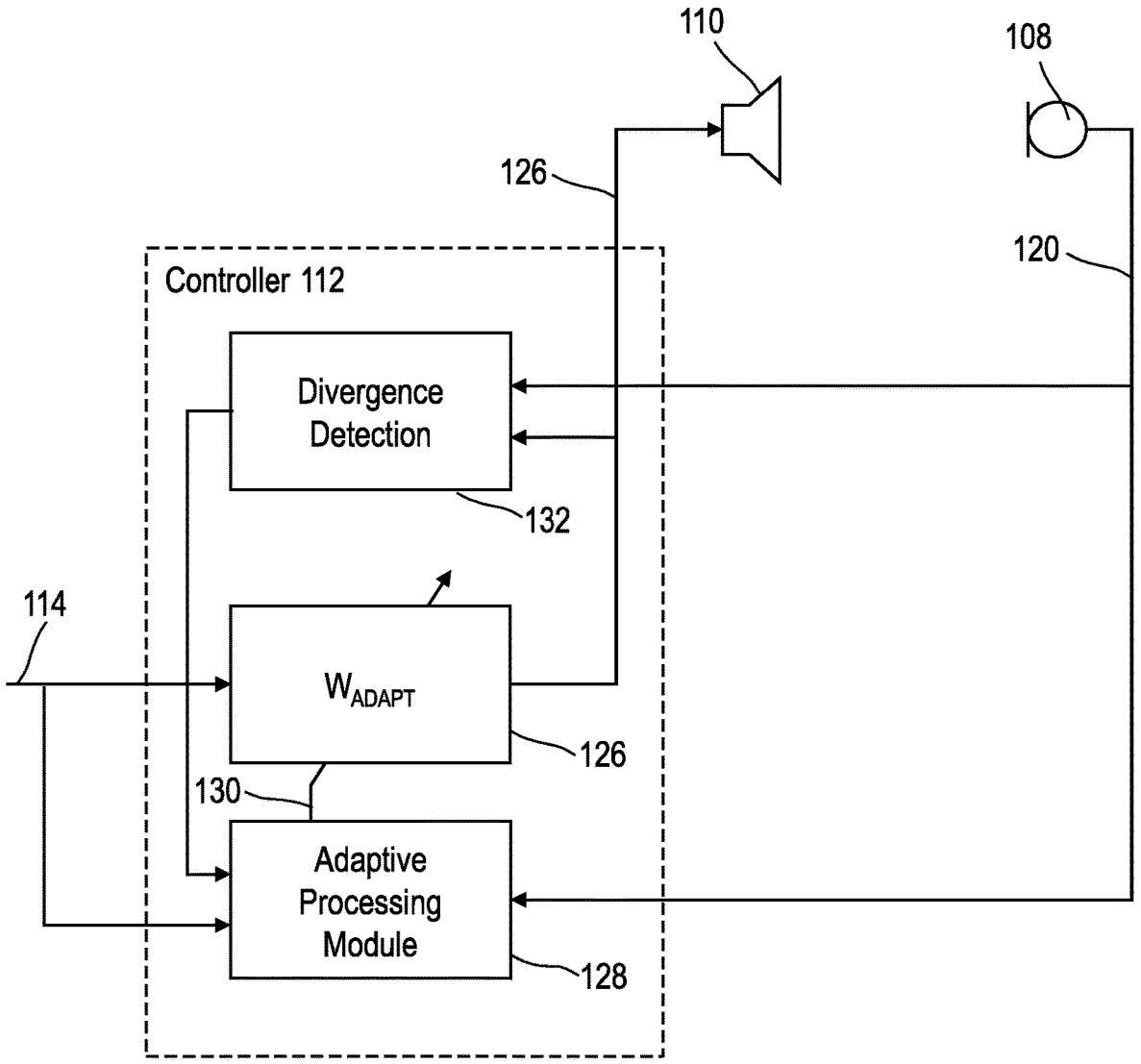
FIG. 2 depicts a block diagram of a road-noise cancellation system with divergence detection, according to an example.

Turning to FIG. 2, there is shown a block diagram of an example of noise-cancellation system 100, including a plurality of filters implemented by controller 112. As shown, controller can define a control system including $W_{adapt}$ filter 126 and an adaptive processing module 128.

$W_{adapt}$ filter 126 is configured to receive the noise signal 114 of reference sensor 106 and to generate noise-cancellation signal 118. Noise-cancellation signal 118, as described above, is input to actuator 110 where it is transduced into the noise-cancellation audio signal that destructively interferes with the undesired sound in the predefined cancellation zone 102. $W_{adapt}$ filter 126 can be implemented as any suitable linear filter, such as a multi-input multi-output (MIMO) finite impulse response (FIR) filter. $W_{adapt}$ filter 126 employs a set of coefficients which define the noise-cancellation signal 118 and which can be adjusted to adapt to changing behavior of the vehicle response to road input (or to other inputs in non-vehicular noise-cancellation contexts).

The adjustments to the coefficients can be performed by an adaptive processing module 128, which receives as inputs the error sensor signal 120 and the noise signal 114 and, using those inputs, generates a filter update signal 130. The filter update signal 130 is an update to the filter coefficients implemented in $W_{adapt}$ filter 126. The noise-cancellation signal 118 produced by the updated $W_{adapt}$ filter 126 will minimize error sensor signal 120, and, consequently, the undesired noise in the cancellation zone.

The coefficients of W adapt filter 126 at time step n can be updated according to the following equation:

$$W_{adapt}[n+1] = W_{adapt}[n] + \mu(\tilde{T}'_{de} * e)\frac{x}{\|x\|_2} \tag{1}$$

where $\tilde{T}_{de}$ is an estimate of the physical transfer function between actuator 110 and the noise-cancellation zone 102, $\tilde{T}'_{de}$ is the conjugate transpose of $\tilde{T}_{de}$, e is the error signal, and x is the output signal of reference sensor 106. In the update equation, the output signal x of reference sensor is divided by the norm of x, represented as $\|x\|_2$.

In application, the total number of filters is generally equal to the number of reference sensors (M) multiplied by the number of speakers (N). Each reference sensor signal is filtered N times, and each speaker signal is then obtained as a summation of M signals (each sensor signal filtered by the corresponding filter).

Divergence detector 300, as described in detail below, receives error sensor signal 120 and noise-cancellation signal 118, and, using those inputs, determines whether road-noise cancellation system 100 is likely diverging or unstable. The road-noise cancellation system 100, in response to that measure, can take corrective action to mitigate the divergence or instability. Divergence detector 300 can detect divergence and/or instability by monitoring the power of a component of the error sensor signal 120 that should be minimized by the adaptive system. For example, in the context of road-noise cancellation system 100, the power of a component of the error signal 120 correlated to road noise should remain small. If the power of the component of the error signal 120 correlated to road noise begins growing, it can be determined that the adaptive filter $W_{adapt}$ filter 126 is diverging.

As described above, in the example of road-noise cancellation system 100, the reference sensor 106 can be positioned to detect vibrations in the vehicle structure that are perceived by a passenger as road noise, while the error sensor 108 can be positioned to detect all noise within the cabin or a subset of noise within the cabin (e.g., noise falling within a particular cancellation zone and within a particular frequency range). In this example, the error sensor 108 will detect additional noises in the cabin that are not the result of road noise, e.g., not the result of vibrations in the vehicle structure, such as music playing within the cabin, the talking of passengers within the cabin, wind passing by the vehicle, etc. The error sensor signal y(n) may thus be represented as a sum of its components, as follows:

$$y(n)=y_a(n)+y_{resi}(n) \tag{2}$$

where, for the purposes of this disclosure, $y_a(n)$ is the component of the error sensor signal correlated to the road noise and $y_{resi}(n)$ is the residual component that is uncorrelated with the road noise.

The component $y_a(n)$ of the error sensor signal 120 correlated to the road noise can be estimated any number of ways; however, it is particularly efficient to estimate this value by correlating the error sensor signal 120 with the noise-cancellation signal 118. Because the noise-cancellation signal 118 is already configured to cancel noise within the cabin, and thus is an estimate of the road-noise phase shifted, the component $y_a(n)$ of the error sensor signal 120 correlated to the road noise will largely be correlated to the noise-cancellation signal 118. Thus, divergence detector can estimate the component $y_a(n)$ of the error sensor signal 120 correlated to the road noise by correlating the error sensor signal 120 to the noise-cancellation signal 118. In alternative examples, rather than correlating to the noise-cancellation signal 118, the error sensor signal 120 can be correlated with the reference sensor signal 114 to estimate the component $y_a(n)$ of the error sensor signal 120 correlated to the road noise. For the purposes of this disclosure, the estimated component of the error sensor signal 120 that is correlated to the road noise will be referred to as the "error signal component." It will be understood that the error signal component can be determined in any number of potential ways.

Once the error signal component is estimated, at least one of several methods can be used to detect the occurrence of divergence or instability. One such method is to monitor the power of the error signal component over time to determine whether it increases or decreases. Again, as described above, the power of the noise targeted by the noise-cancellation system should generally decrease or remain relatively constant over time. If the power of the error signal component begins to grow, it is evidence that the adaptive filter has diverged. Thus, the time gradient—or some metric related to this time gradient—of the error signal component can be monitored over time to determine whether the adaptive filter has diverged.

However, monitoring the time gradient in this manner can miss rapidly growing divergences. Such divergences can quickly saturate the adaptive filter, and thus the time gradient power of the error sensor component will briefly be positive before becoming zero. Because the time gradient will remain constant once the adaptive filter saturates, the first method for detecting the divergence can fail to register the divergence. Thus, a second method of detecting divergence can be used as a failsafe.

In one example, the second method can determine the relative power of the error signal component over multiple frequencies. Stated differently, in the instance of a divergence, the power of the error signal component at at least one frequency bin will be much greater than the power in at least one other frequency bin. In this case, divergence can be detected by monitoring the relative magnitude of the power in each frequency bin against one or more other frequency bins. For example, each frequency bin of the error signal component can be individually compared against one or more other frequency bins to see if each frequency bin exceeds the power in other frequency bins by some predetermined value. This relative power can be monitored over some period of time before flagging that a divergence has occurred.

If a divergence is detected according to at least one of the methods described above, at least one action can be taken to mitigate the effects of the divergence and attempt to return the adaptive filter to a convergent and stable state. One such method is to transition the coefficients of the adaptive filter to a previously stored set of coefficients. The previously stored set of coefficients can be a set of recently stored coefficients or can be a set of default coefficients. Because the previously stored coefficients are likely not divergent, restoring this set of coefficients will, most likely, resolve the divergence. However, in some instances, where a divergence occurs within a short period of time of storing a set of coefficients, a different set of coefficients (e.g., a default set of coefficients), rather than the most recently set of stored coefficients, can be retrieved and implemented, as the most recent previously stored coefficients are likely corrupted. In most cases, the different set of coefficients are a default set of coefficients, such as a factory setting, although other sets of coefficients, such as coefficients stored during shutdown of the vehicle or at startup, or coefficients that are otherwise stored at some point before the previously stored coefficients, can be used.

In addition to restoring coefficients, the rate of adaptation can be slowed to reduce the risk of a second divergence which can occur if the condition that caused the first divergence is still in effect. Indeed, in one example, the rate of adaptation can be slowed to the point that the adaptive filter becomes a fixed filter. However, to avoid slowing the adaptation in an event that the divergence is a false positive (e.g., where a tonal sound, of the kind often found in classical music, caused the second method to detect a false divergence) the frequency bin at which the divergence was detected can be monitored following the transition. If the power of the frequency bin decreases, it can be assumed that the detected divergence was an actual divergence and the rate of adaptation can be slowed accordingly. If, however, the power of the frequency bin does not decrease, then it can be assumed that that the detected divergence was a false divergence and the rate of adaptation can remain the same.

These methods and other methods of detecting divergence and mitigating divergence will be discussed in greater detail below in connection with FIGS. 3A-3G.

Again, the noise-cancellation system 100 of FIGS. 1 and 2 is merely provided as an example of such a system. This system, variants of this system, and other suitable noise-cancellation systems can be used within the scope of this disclosure. For example, while the system of FIGS. 1-2 has been described in conjunction with a least-means-squares filter (LMS/NLMS), in other examples a different type of filter, such as one implemented with a recursive-lease-squares (RLS) filter can be implemented. Likewise, while a noise-cancellation system with feedback has been described, in alternative examples, such a system can employ a feed-forward topology. Furthermore, while a vehicle-implemented noise-cancellation system for cancelling road noise has been described, any suitable noise-cancellation system can be used.

FIGS. 3A-3G depict a flowchart of a method 300 for detecting divergence in an adaptive system, such as noise-cancellation system 100. As described above, this method can be implemented by a computing device, such as controller 112. Generally, the steps of the computer-implemented method are stored in a non-transitory storage medium and are executed by the processor of the computing device. However, at least some of the steps can be carried out in hardware rather than by software.

Figure 3A:
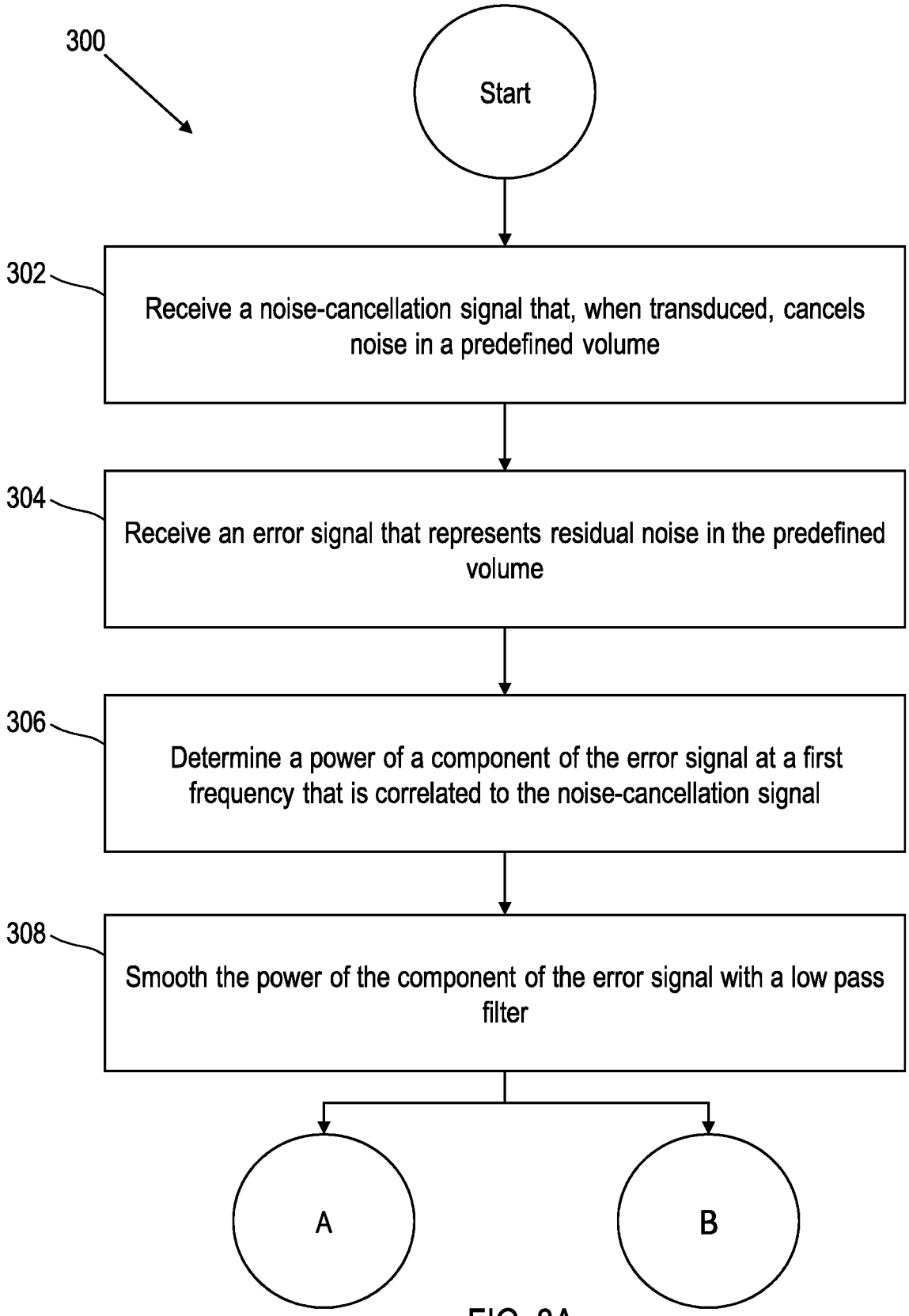
FIG. 3A depicts a flowchart of a method for detecting a divergence in an adaptive system, according to an example.
Figure 3B:
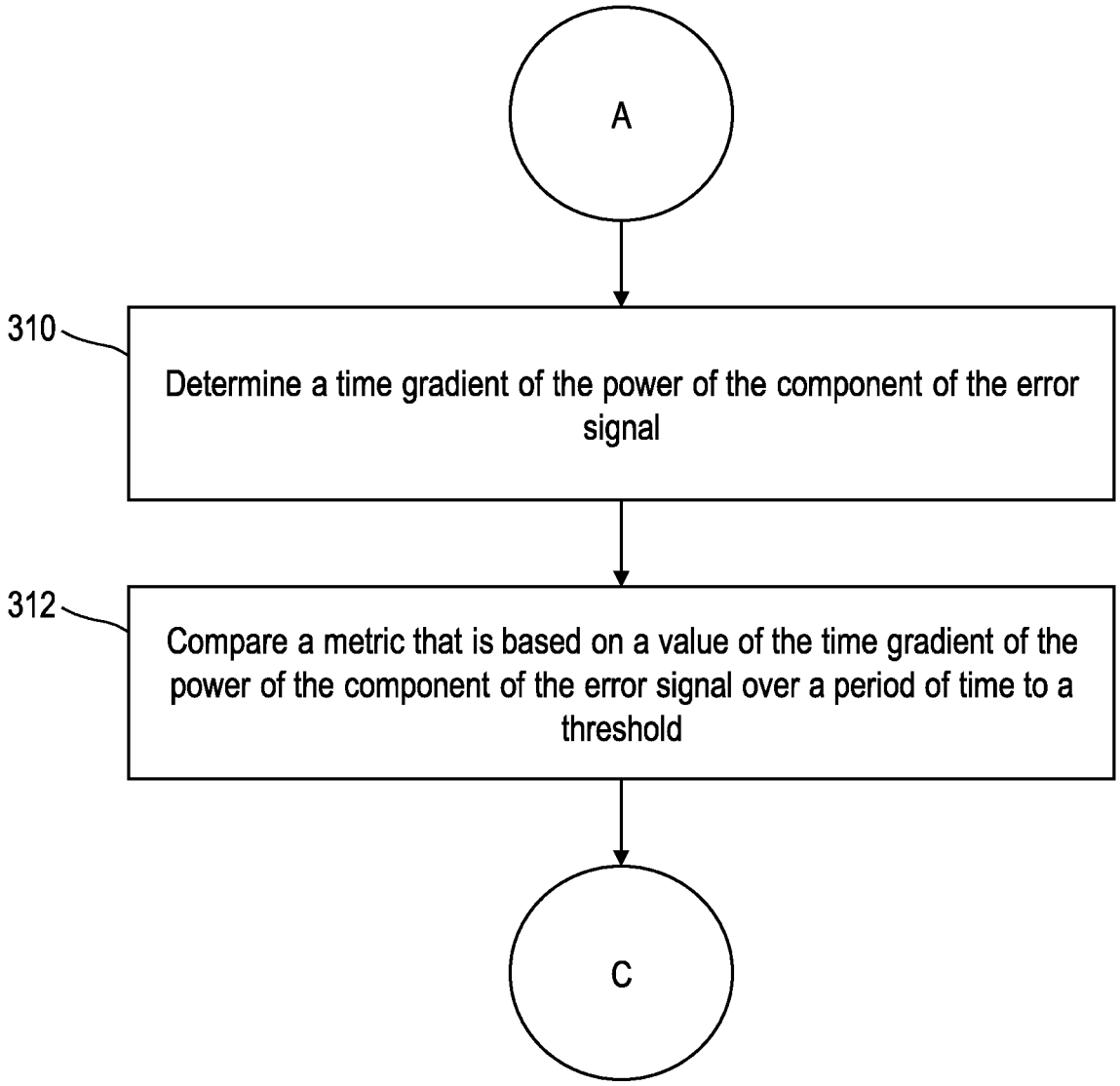
FIG. 3B depicts a flowchart of a method for detecting a divergence in an adaptive system, according to an example.
Figure 3C:
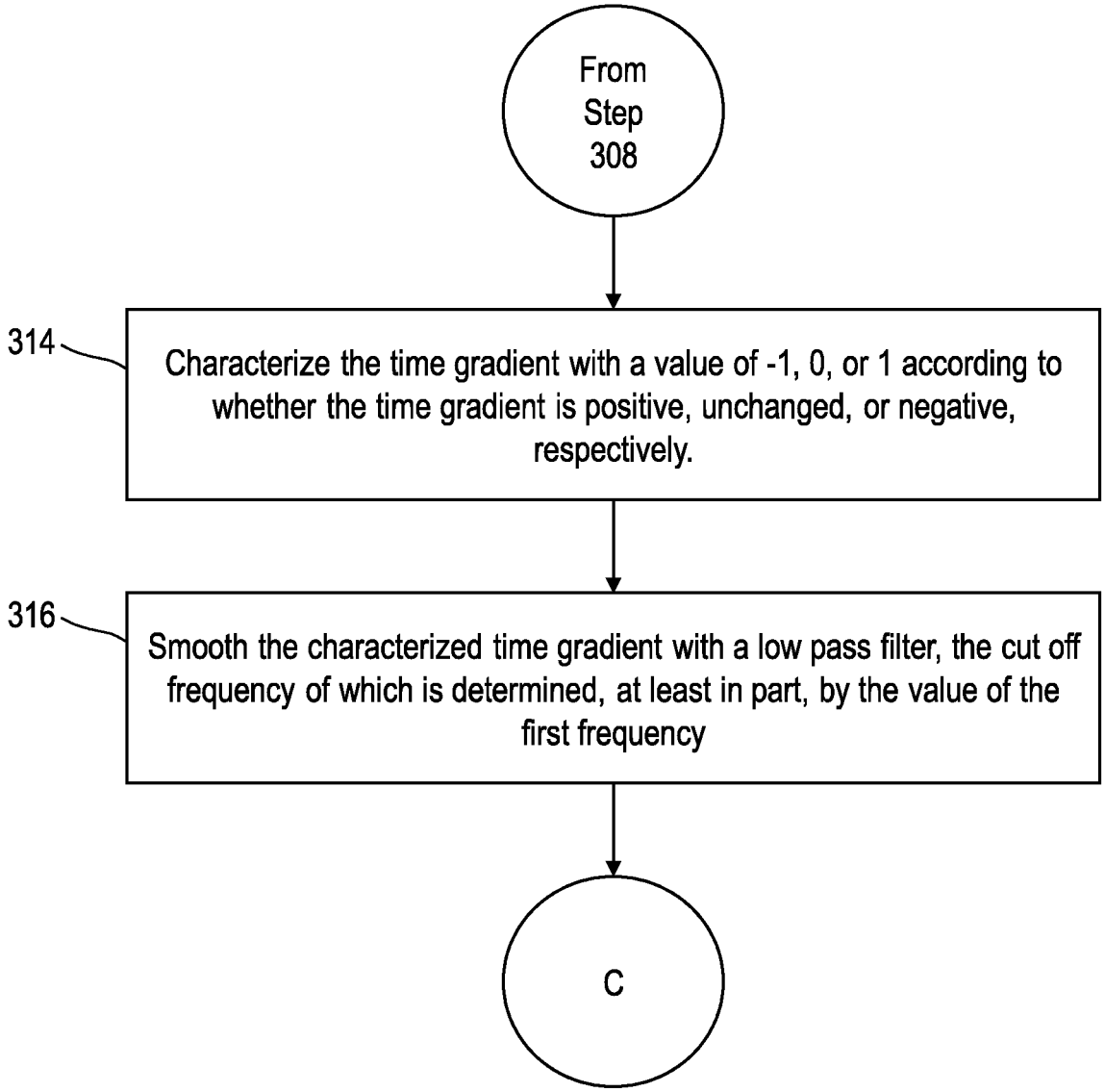
FIG. 3C depicts a flowchart of a method for detecting a divergence in an adaptive system, according to an example.
Figure 3D:
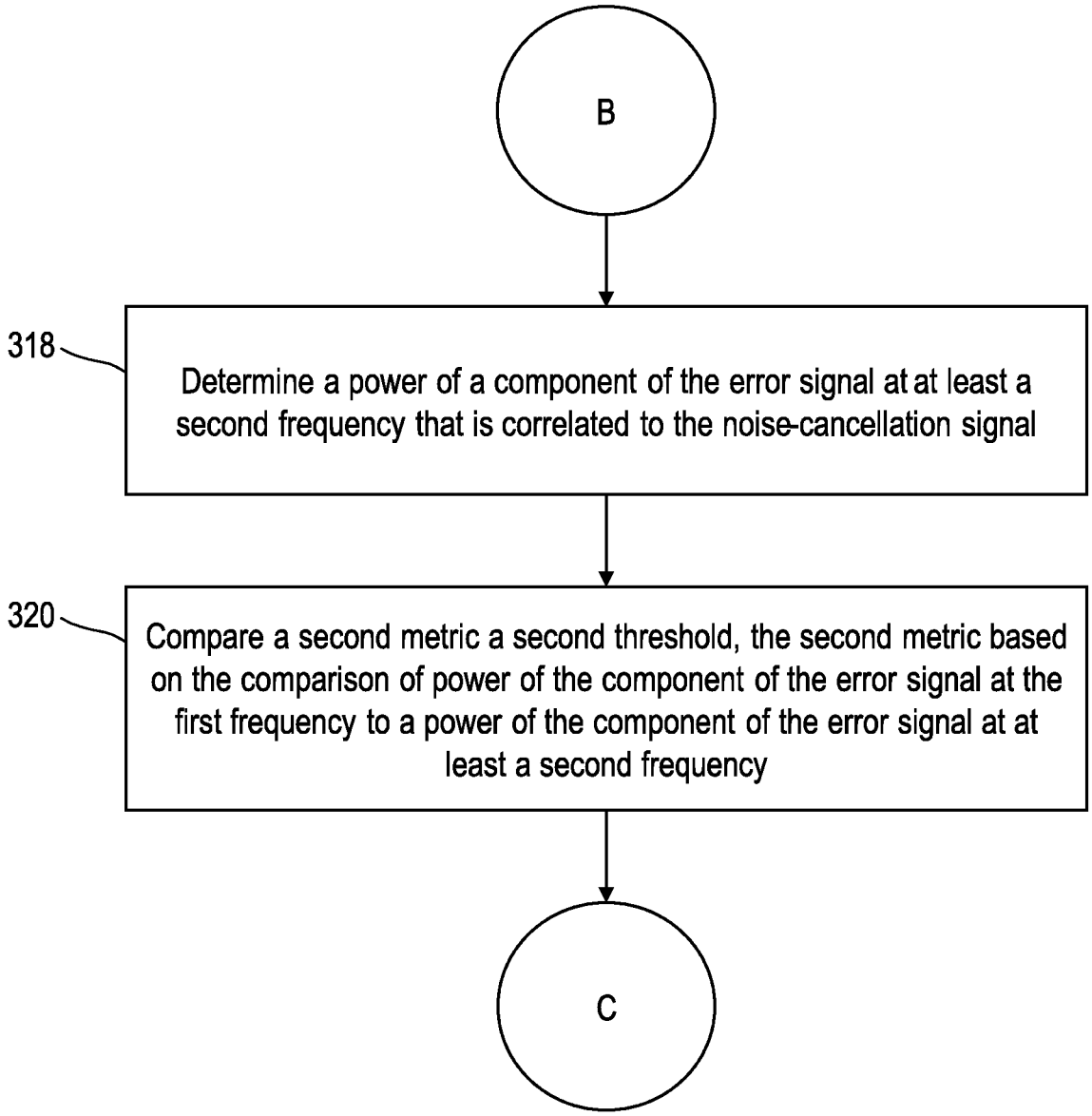
FIG. 3D depicts a flowchart of a method for detecting a divergence in an adaptive system, according to an example.
Figure 3E:
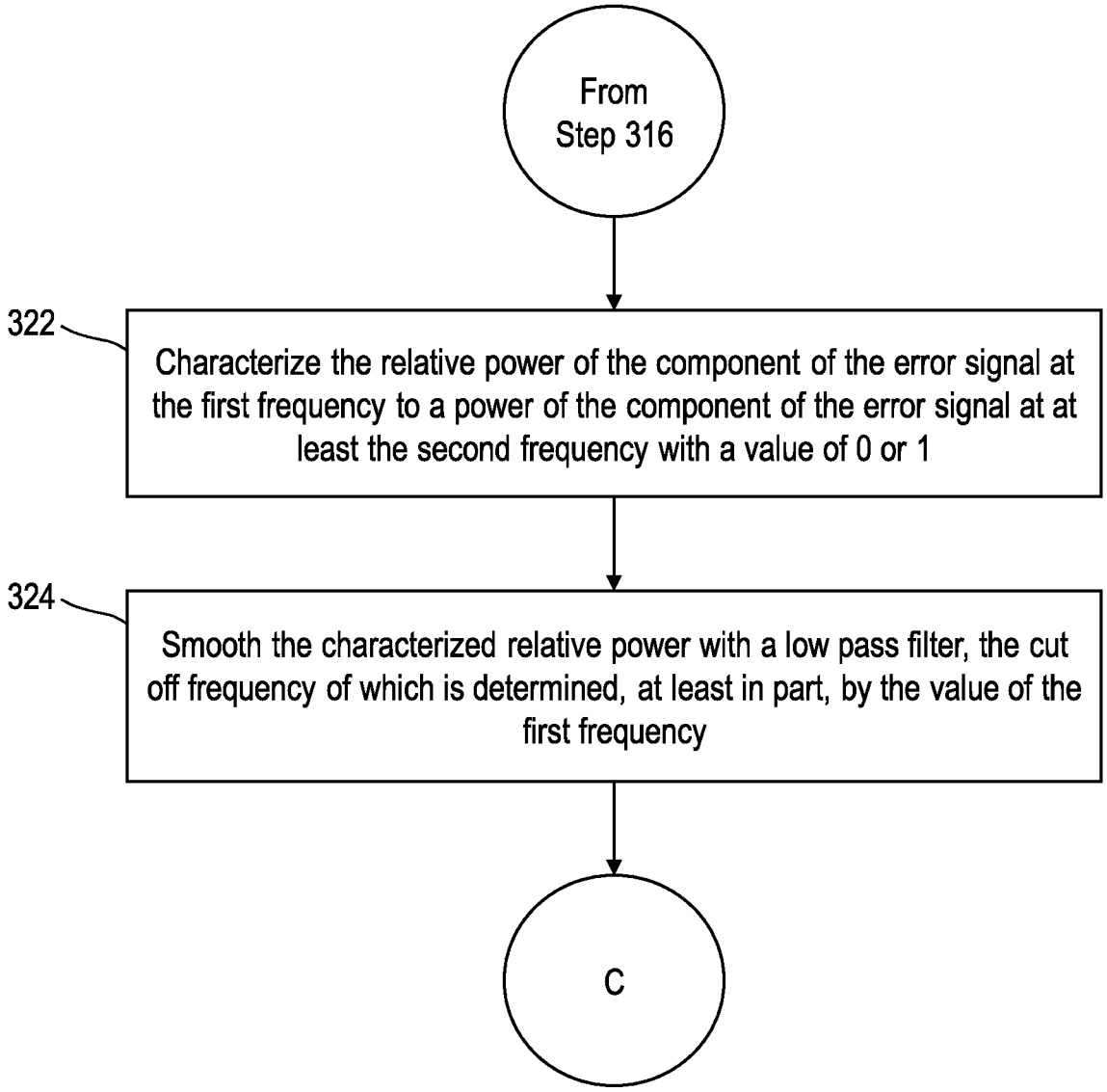
FIG. 3E depicts a flowchart of a method for detecting a divergence in an adaptive system, according to an example.

Turning first to FIG. 3A, at step 302 a noise-cancellation signal that is configured to cancel noise within a predetermined volume is received. For example, this noise-cancellation signal can be configured to cancel noise within at least one cancellation zone within a vehicle cabin (as described in the example above, in connection with FIG. 1). In another example, if the noise-cancellation system is employed in a pair of noise-cancelling headphones, this noise-cancellation signal can be configured to cancel noise in a predefined volume created by the earcups of the headphones disposed about the user's ears.

At step 304, an error signal that represents residual noise in the predefined volume is received. This error signal can be an error signal received from an error sensor, such as error sensor 108 producing error sensor signal 120. Alternatively, this error signal can be received from any error sensor configured to detect residual (i.e., uncancelled) noise within the volume, such as an error signal from an error microphone disposed within a pair of noise-cancelling headphones. Furthermore, more than one error signals can be received. For example, multiple error sensors can be disposed within the vehicle cabin. These error signals can be used individually (e.g., the method steps described below can be repeated for each received error signal) or the error signals can be combined in some way, creating a composite error signal (which, for the purposes of this disclosure, is still regarded as an "error signal"). In one example, the error signals can be combined by averaging. However, it is contemplated that other ways of combining multiple error signals can be used. In another example, one error signal can be selected from multiple error signals for a given iteration of method 300. For example, as will be described below, the maximum power value for a given frequency, out of multiple error signals, can be selected for a given run of method 300.

At step 306, a power of the error signal at a first frequency that is correlated to the noise-cancellation signal is determined. As described above, this is an efficient method of determining the error signal component, which is an estimation of the component of the error signal that is correlated to the noise reduced by the noise-cancellation system. The correlation can be accomplished through any suitable method, such as by inputting the error signal to a least means squared algorithm that uses the noise-cancellation signal as a reference signal. To determine the power of the error signal component at a first frequency, the correlated signal can be input to a frequency transform algorithm that yields the absolute value of the error signal component as a function of frequency. Any suitable frequency transform algorithm, such as a discrete Fourier transform, a fast Fourier transform, discrete cosine transform, etc., can be used. Of course, using a frequency transform algorithm, such as those identified above, will likely yield the power of the error signal component at more than only one frequency, but one frequency of this can be selected as the "first frequency" (i.e., the frequency under test) for the remaining steps of method 300. It should be understood that the remaining frequencies (i.e., those not selected as the "first frequency") can be selected as the "first frequency" in concurrent or iterative loops of method 300. Stated differently, method 300 can be repeated for each frequency or for a subset of frequencies found from the frequency transform algorithm. As mentioned above, where multiple error signals are received from multiple error sensors, the power of the error sensor component can be found for each error signal, and the maximum power value of the first frequency can be selected as the power at the first frequency for the purposes of the remaining steps of method 300.

At step 308, the power of the error signal component at the first frequency can be smoothed by filtering the power with a low pass filter. Mathematically, a power spectrum of a signal is found according to the expected value of the frequency transform of the signal. A practical way of finding an expected value is to use a low pass filter. This step typically assumes that at least one historic value of power of the error signal component at the first frequency (i.e., from previous samples) can be input to the low pass filter, as the filter will smooth the power of the error signal component with respect to the historic values, according to a mathematical function. In alternative examples, other smoothing techniques, such as using an exponential moving average across a buffered set of historic values, can be used to find the expected value. It should be understood that in various alternative examples, the smoothing can be omitted, and non-smoothed values can be used in the following steps. The smoothed output of step 308 can be input to at least two separate methods of detecting divergence, which are represented in FIG. 3 as branches A and B.

Turning first to branch A, at step 310, a time gradient of the power of the error signal component is determined. The time gradient, stated differently, is the change in power of the error signal component (which can be the smoothed error signal component) from the previously calculated power of the error signal component.

At step 312, a metric that is based on the time gradient of the power of the error signal component over a period of time can be compared to a threshold. In one example, the metric can be determined according to sub-steps 314 and/or 316. At step 314, each time gradient is characterized with a value of −1, 0, or 1, according to whether the time gradient is positive, unchanged, or negative, respectively. Step 314, thus ignores the magnitude of the change between successive samples, leaving only the direction of the time gradient. Large changes are thus treated the same as small changes. This further operates to smooth large jumps in power due to rapid transients in the error signal. At step 316, the characterized time gradient is smoothed with respect to at least one historic value using a low-pass filter, the cut-off frequency of which is selected according to the frequency of the "first frequency." For example, multiple low pass filters, each having separate cut-off frequencies, can be used for separate bands of frequencies values. The low-pass filter of the multiple filters used for step 316 can be determined according to the value of the first frequency. Smoothing the characterized time gradient with respect to the historic values will help to mitigate quick jumps in power at the first frequency, which can be anomalous transients, rather than evidence of a divergence, while still detecting jumps that persist for more than one sample.

The result of steps 314 and 316 will be a metric, the value of which represents the trend of the time gradient over a period of time. If the value of the metric is greater than 0, the power of the error signal component at the first frequency is trending upward (i.e., generally increasing); whereas, if the value of the metric is less than 0, the power of the error signal component at the first frequency is trending downward (i.e., generally decreasing). The value of this metric can be compared to a threshold value. Thus, when the power of the error signal component trends upward for a period of time, the value of the metric will exceed the threshold, representing a detected divergence.

It should be understood that, in alternative examples, different metrics based on the value of the time gradient of the error sensor component over a period of time can be used. For example, rather than using a low-pass filter to smooth the characterized time gradient, other methods of smoothing, such as an exponential moving average of buffered historic values of the characterized time gradient can be used. However, because monitoring the trend at lower frequencies will require larger buffers of values to match the higher frequencies, which is memory intensive, it is more efficient to apply a low pass filter to the values. In another example, the time gradient need not be characterized with a value such as −1, 0, or 1; instead the magnitude of the time gradient can be directly smoothed. However, failing to characterize the value will likely make the divergence detector more susceptible to false positives from rapid transients in the power of the error signal component.

Turning now to branch B, a second method for detecting a divergence is shown. As described above, monitoring the time gradient in the manner described in connection with branch A can miss rapidly growing divergences, since such divergences can quickly saturate the adaptive filter and thus appear like constant power. However, such rapid divergences will likely saturate the adaptive filter at certain frequencies but not others. Branch B thus monitors the relative power of the first frequency bin against the power of at least a second frequency bin to determine when the adaptive filter has rapidly diverged.

At step 318, a power of the error signal component at at least a second frequency is determined. This step likely occurs concurrent with step 306, when the error signal component is input to the frequency transform algorithm but is included in FIG. 3D as a separate step for the sake of completeness and clarity. (It is, however, conceivable that the values of the power of error signal component at the first frequency and the second frequency could be determined at separate times.)

At step 320, a second metric based on a comparison of the power of the error signal component at the first frequency to the power of the error signal component at the second frequency can be compared to a second threshold. The second metric can, in one example, be given by sub-steps 322 and/or 324. At step 322, the relative power of the error signal component at the first frequency against the error signal component at at least the second frequency is characterized with a value of 0 or 1 depending on whether the power of the error signal component of the first frequency exceeds the power of the error signal component of at least the second frequency by some threshold value (e.g., 0.15). Thus, the relative powers are characterized with a 1 if the power of the error signal component of the first frequency exceeds the power of the error signal component of at least the second frequency by more than the threshold, and with a 0 if the power of the error signal component of the first frequency does not exceed the power of the error signal component of at least the second frequency.

Generally speaking, "relative power" can be given by any suitable comparison of the power of the respective frequency bins. For example, the relative power can be given by the ratio of the power of the first frequency bin to the sum of the power of the first frequency bin and second frequency bin, as follows:

$$p_{relative} = \frac{p_1}{p_1 + p_2} \tag{3}$$

where $p_{relative}$ is the relative power between the first frequency bin and the second frequency power, $p_1$ is power of the first frequency bin, and $p_2$ is the power of the second frequency bin. Alternatively, the relative power can be given by the simple difference between the power of the first frequency bin with the power of a second frequency bin.

The power of the error signal component at the first frequency can be compared to the power of the error signal component at more than one other frequency values in a variety of ways. For example, the power of the error signal component at the first frequency can be compared, individually, to error signal components at multiple other frequencies (e.g., a set of neighboring frequency values or representative frequencies). The relative power being characterized as a 1 if the power of the error signal component at the first frequency exceeds the power of the error signal component at any other compared frequency by a predefined threshold. Alternatively, the power at multiple frequency values can be averaged or otherwise combined and compared to the power at the first frequency value. If the power at the first frequency exceeds the combined power of multiple other frequency values by a predefined threshold, then the relative power is characterized with a 1 as the power at the first frequency necessarily exceeds the power at at least a second frequency.

Similar to step 316, at step 324 the characterized relative power of step 322 is smoothed with at least one historical value of the characterized relative power with a low pass filter, the cut-off frequency of which is determined by the value of the first frequency. The net result of steps 322 and 324 will be a second metric, the value of which represents a trend over a period of time of relative power between the error signal component at the first frequency and the error signal component at at least the second frequency. The value of the second metric rising above 0 occurs as a result of the power of the error signal component of the first frequency is repeatedly exceeding the threshold over multiple samples. The value of the second metric can be compared to a threshold value (e.g., 0.25) and represents a detected divergence when the threshold is exceeded.

It should be understood that, in alternative examples, different metrics based on the relative power over a period of time can be used. For example, rather than using a low-pass filter to smooth the characterized relative power, other methods of smoothing, such as an exponential moving average of buffered historic values of the power of the error signal component can be used. In another example, the relative power need not be characterized with a value such as 0 or 1; instead, the relative power values can be directly smoothed and compared to the threshold. However, failing to characterize the value will, again, likely make the divergence detector more susceptible to false positives from rapid transients in the power of the error signal component.

Furthermore, to the extent that steps 314 and 322 describe characterizing a value with a value of −1, 0, or 1 or with a value of 0 or 1, these are only provided as example values that might be used. A person of ordinary skill in the art, in conjunction with a review of this disclosure, will understand that other values can be used while maintaining the same concept of characterizing a time gradient or relative power.

Branch A and branch B both feed into step 326, which begins an action to correct the divergence detected by the previous branches. It should be understood that branch A and branch B are merely examples of methods for detecting divergences and that the mitigating actions described here can be used in connection with other methods of detecting divergence. Indeed, in some examples, only one of branch A or branch B can be implemented. Alternatively, one of branch A or branch B can be used in connection with another method of detecting divergence. In yet another example, different methods of detecting divergence can be used without using one of the methods described in branch A or branch B.

At step 326, the coefficients of the adaptive filter, which likely caused the detected divergence, are transitioned to a second set of previously stored coefficients upon a divergence being detected by either branch A or branch B (or from another method of detecting divergence). In one example, the transition can occur over multiple samples so that the user does not notice the transition; however, this is not necessary, and in an example, the transition can occur before the next sample is received. The previously stored coefficients can be a default set of coefficients or can be stored during the operation of the adaptive filter prior to divergence. For example, during the operation of the adaptive filter prior to divergence, the coefficients can be stored at a predetermined or variable interval of time. Once the divergence is detected, the most recently stored set of coefficients can be retrieved and transitioned to. In most instances of divergence, this will stop the divergence from continuing and reset the coefficients to a stable, convergent set of coefficients.

In addition to transitioning to a previously stored set of coefficients, at step 328, the rate of adaptation of the adaptive filter can be slowed in order to reduce the risk of a second divergence which can occur if the condition that caused the first divergence is still in effect. Indeed, in one example, the rate of adaptation can be slowed to the point that the adaptive filter becomes a fixed filter. However, in certain instances the detected divergence can be a false positive (i.e., not indicative of a true divergence). This can especially happen in instances in which a tonal sound is played through the speakers in the vehicle. This often occurs, for example, when classical music, which frequently features tonal sounds, is played in the cabin. Such tonal sounds tend to excite certain frequencies in the error signal and thus create the appearance of divergence to the method described in connection with branch B. To avoid slowing the rate of adaptation unnecessarily, the first frequency (in which the divergence was detected) can be monitored over a period of time after or during transitioning to the second coefficients, to see if the power at the first frequency decreases. If the power at the first frequency decreases after or during transition to the second set of coefficients, it can be assumed that the divergence that occurred was a true divergence (i.e., not a false positive) and the rate of adaptation can be slowed. However, if the power at the first frequency does not decrease after or during transition to the second set of coefficients, it can be assumed that the divergence was a false positive and the rate of adaptation can be kept the same.

In order to determine whether the power of the first frequency (that is the frequency-under-test, which, at this step, has triggered the divergence) decreases after or during transition, the time gradient of the first frequency can be monitored during transition or after the transition has completed. This is shown as sub-steps 332 and 334 and mirrors the steps 310 and 312 described above. Generally speaking, a metric based on the value of the time gradient of the error signal component at the first frequency can be compared to a threshold to determine whether the power at this frequency is decreasing over time. The threshold, in this instance, detects when the power of the first frequency is decreasing and thus the threshold is negative (e.g., −0.8) in order to detect when the smoothed characterized time gradient is trending downward. (It should, however, be understood that negative time gradient values can be simply converted to positive values, by, for example, multiplying by −1, and thus can be compared to a positive threshold.) If the threshold has been exceeded, it can be determined that the power decreased after or during transition and was thus likely a result of a true divergence and the rate of adaptation can be slowed. If, however, the threshold is not exceeded after a set period of time, then it was likely a false positive and the rate of adaptation will remain the same.

Figure 3F:
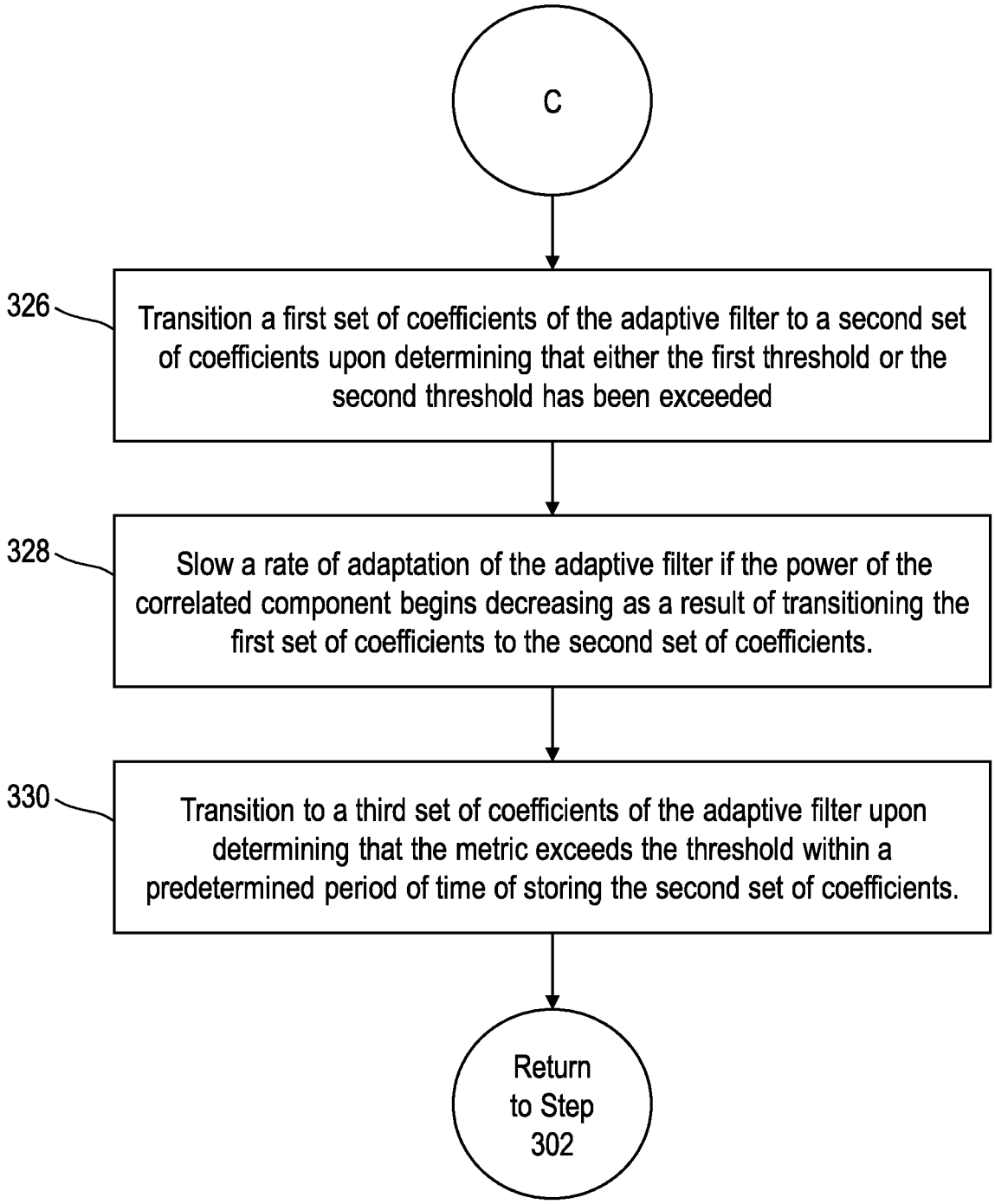
FIG. 3F depicts a flowchart of a method for detecting a divergence in an adaptive system, according to an example.
Figure 3G:
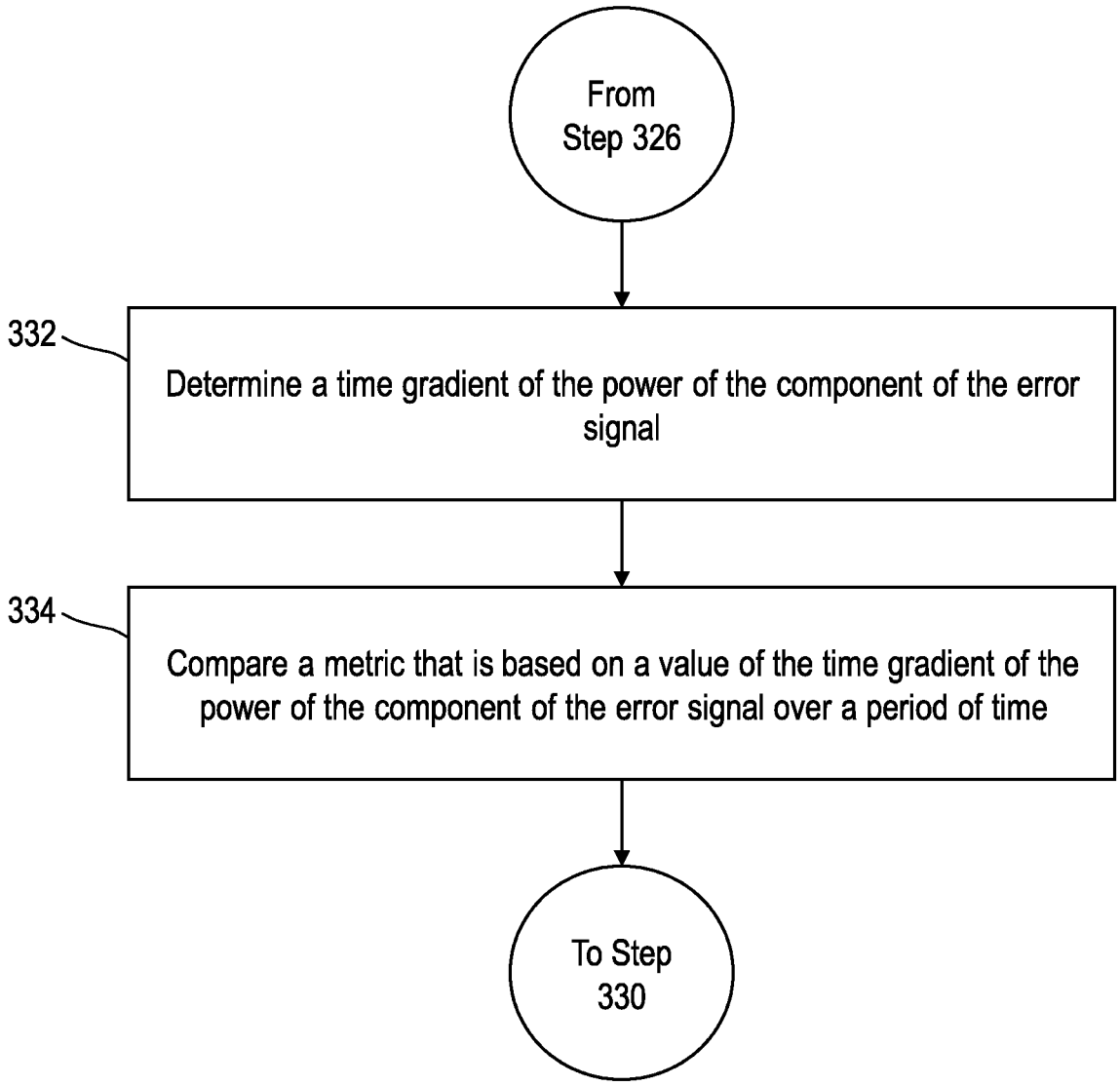
FIG. 3G depicts a flowchart of a method for detecting a divergence in an adaptive system, according to an example.

Step 330 in FIG. 3F represents an alternative to step 326, which is implemented if a divergence is detected within a predetermined period of time from storing the last set of previously stored coefficients. For example, if the coefficients are stored at intervals during the operation of the adaptive system, a timer can be set to determine the length of time that has elapsed from the point that a set of coefficients were stored. When a divergence occurs, the timer can be compared to a predetermined length of time. If the divergence has occurred within the predetermined length of time from the point that the last set of coefficients were stored, it is likely that the last set of stored coefficients are corrupted. Thus, at step 330, the adaptive filter can be transitioned to a third set of coefficients. The third set of coefficients can be a default coefficients or coefficients that were stored prior to storing the second set of coefficients and which are likely to be stable and convergent.

It will be understood that step 330 can be implemented in the example in which step 326 restores the most recently stored set of coefficients. If, instead, step 326 restores a default set of coefficients, it is not necessary to check whether the stored coefficients are likely to be sufficiently stable.

The methods of correcting the divergence described above are only one example of such methods that can be used in conjunction with the methods of detecting divergence described in this disclosure. In various examples, corrective actions that can be taken in conjunction with or instead of the corrective action described, include: turning the adaptive system off, or target certain frequencies of the adaptive filter that are diverging, by filtering those frequencies to mitigate their gain, reducing the adaptive filter coefficients with respect to those frequencies, or freezing adaption corresponding to those frequencies.

As described above, the steps of method 300 can be repeated for multiple frequency values (the value of the "first frequency" changing at each iteration). Further, the steps of method 300 can be repeated over time as new samples are received from the error sensor in order to continually monitor for divergence. Thus, method 300 functions as a loop that can detect divergences during the operation of the adaptive filter.

The functionality described herein, or portions thereof, and its various modifications (hereinafter "the functions") can be implemented, at least in part, via computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A non-transitory storage medium storing program code for detecting divergence or instability in a noise-cancellation system, the program code, being executed by a processor, comprising the steps of:

determining a power of a component of an error signal at a first frequency, the component being correlated to a noise-cancellation signal, the noise-cancellation signal being produced by an adaptive filter and being configured to cancel noise within a predetermined volume when transduced into acoustic signal, wherein the error signal represents a magnitude of a residual noise within the predetermined volume;

determining a time gradient of the power of the component of the error signal; and comparing a metric to a threshold, wherein the metric is based, at least in part, on a value of the time gradient of the power of the component of the error signal over a period of time.

2. The non-transitory storage medium of claim 1, wherein the program code further comprises the step of: transitioning a first set of coefficients of the adaptive filter to a second set of coefficients of the adaptive filter upon determining that the metric exceeds the threshold.

3. The non-transitory storage medium of claim 2, wherein the program code further comprises the step of slowing a rate of adaptation of the adaptive filter if the power of the component begins decreasing as a result of transitioning the first set of coefficients to the second set of coefficients.

4. The non-transitory storage medium of claim 1, wherein the program code further comprises the step of: transitioning to a third set of coefficients of the adaptive filter upon determining that the metric exceeds the threshold within a second period of time of storing a second set of coefficients.

5. The non-transitory storage medium of claim 1, wherein the metric is a filtered representation of the time gradient over the period of time, wherein the representation of the time gradient is filtered with a low-pass filter.

6. The non-transitory storage medium of claim 5, wherein a cut-off frequency of the low-pass filter is selected according the first frequency.

7. The non-transitory storage medium of claim 1, wherein the program code further comprises the steps of: comparing a second metric to a second threshold, wherein the second metric is based on a comparison of the power of the component of the error signal at the first frequency to the power of the component of the error signal at at least a second frequency.

8. The non-transitory storage medium of claim 7, wherein the program code further comprises the step of: transitioning a first set of coefficients of the adaptive filter to a second set of coefficients of the adaptive filter, upon determining that either the metric exceeds the threshold or the second metric exceeds the second threshold.

9. The non-transitory storage medium of claim 8, wherein the program code further comprises the step of slowing a rate of adaptation of the adaptive filter if the power of the correlated component begins decreasing as a result of transitioning the first set of coefficients to the second set of coefficients.

10. The non-transitory storage medium of claim 7, wherein the second metric is a filtered representation of a relative power of the component of the error signal at the first frequency and the component of the error signal at the second frequency, wherein the representation of the relative power is filtered with a low-pass filter.

11. A method for detecting divergence in a noise-cancellation system, comprising:

determining a power of a component of an error signal at a first frequency, the component being correlated to a noise-cancellation signal, the noise-cancellation signal being produced by an adaptive filter and being configured to cancel noise within a predetermined volume when transduced into acoustic signal, wherein the error signal represents a magnitude of a residual noise within the predetermined volume;

determining a time gradient of the power of the component of the error signal; and comparing a metric to a threshold, wherein the metric is based, at least in part, on a value of the time gradient of the power of the component of the error signal over a period of time.

12. The method of claim 11, further comprising the step of: transitioning a first set of coefficients of the adaptive filter to a second set of coefficients of the adaptive filter upon determining that the metric exceeds the threshold.

13. The method of claim 12, further comprising the step of: slowing a rate of adaptation of the adaptive filter if the power of the component begins decreasing as a result of transitioning the first set of coefficients to the second set of coefficients.

14. The method of claim 12, further comprising the step of: transitioning to a third set of coefficients of the adaptive filter upon determining that the metric exceeds the threshold within a second period of time of storing a second set of coefficients.

15. The method of claim 11, wherein the metric is a filtered representation of the time gradient over the period of time, wherein the representation of the time gradient is filtered with a low-pass filter.

16. The method of claim 15, wherein a cut-off frequency of the low-pass filter is selected according the first frequency.

17. The method of claim 11, further comprising the step of: comparing a second metric to a second threshold, wherein the second metric is based on a comparison of the power of the component of the error signal at the first frequency to the power of the component of the error signal at at least a second frequency.

18. The method of claim 17, further comprising the step of: transitioning a first set of coefficients of the adaptive filter to a second set of coefficients of the adaptive filter upon determining that either the metric exceeds the threshold or the second metric exceeds the second threshold.

19. The method of claim 18, further comprising the step of: slowing a rate of adaptation of the adaptive filter if the power of the correlated component begins decreasing as a result of transitioning the first set of coefficients to the second set of coefficients.

20. The method of claim 17, wherein the second metric is a filtered representation of a relative power of the component of the error signal at the first frequency and the component of the error signal at the second frequency, wherein the representation of the relative power is filtered with a low-pass filter.

* * * * *